United States Patent [19]

Margen et al.

[11] 4,099,555

[45] Jul. 11, 1978

[54] CONVECTOR HAVING A FLATTENED PLASTIC TUBE SPIRAL

[75] Inventors: Peter Heinrich Erwin Margen; Jan Anders Bosaeus, both of Nykoping; Bengt Olof Roland Skårud, Vasteras, all of Sweden

[73] Assignee: Aktiebolaget Atomenergi, Stockholm, Sweden

[21] Appl. No.: 638,546

[22] Filed: Dec. 8, 1975

[30] Foreign Application Priority Data

Dec. 18, 1974 [SE] Sweden ..... 7415956

[51] Int. Cl.[2] ..... F24H 9/08

[52] U.S. Cl. ..... 165/55; 165/129; 165/172

[58] Field of Search ..... 248/65, 68 R, 67, 70; 165/130, 131, 52, 53, 54, 129, 67, 76, 55

[56] References Cited

U.S. PATENT DOCUMENTS

| | | | |
|---|---|---|---|
| 2,397,291 | 3/1946 | Robertson | 248/68 R |
| 2,703,702 | 3/1955 | Meimel | 165/171 X |
| 2,873,097 | 2/1959 | Brandi | 165/55 X |
| 3,259,184 | 7/1966 | Trulaske | 165/171 |
| 3,815,672 | 6/1974 | Bullard et al. | 165/171 |

FOREIGN PATENT DOCUMENTS

| | | | |
|---|---|---|---|
| 2,403,375 | 7/1975 | Fed. Rep. of Germany | 248/68 |
| 374,306 | 6/1932 | United Kingdom | 165/131 |

*Primary Examiner*—Charles J. Myhre
*Assistant Examiner*—Theophil W. Streule, Jr.
*Attorney, Agent, or Firm*—Burns, Doane, Swecker & Mathis

[57] ABSTRACT

There is provided a convector comprising a plastic tube arranged in the shape of a flattened helix, the major flat sides of which are displaced relative to each other in the axial direction of the helix, such that the bend radius of the tube at the minor sides of the helix is substantially longer than half the distance between the major sides of the flattened helix.

The convector can be produced by starting with a supply of plastic tubing, forming a bend in the tube, inserting the bend in a slot in one of a pair of parallel support structures, each having a series of oblique and parallel slots, forming a fresh bend in the tube and inserting the bend in a slot on the other structure, and so on.

5 Claims, 12 Drawing Figures

6
5
1
II
II
III
III
7
9
2
9
3
9
2
8
9

CONVECTOR HAVING A FLATTENED PLASTIC TUBE SPIRAL

The present invention relates to a convector containing a flattened plastic tube spiral and at least one tube spreader.

Convectors containing spiral-wound tubing have been disclosed in Swiss Pat. No. 170 712.

In plastic tube convectors of this kind, thin-walled tube is required in order to achieve good heat transfer. Further, it is required that the convector shall be thin so that it occupies only a small amount of space.

These requirements are in conflict with one another since thin-walled tube has a larger minimum bend radius than thick-walled tube and the thickness of the convector depends upon the permissible tube bend radius.

Swiss Pat. No. 170 712 discloses a method of spreading the tube coils out in the horizontal sense so that each part of the coils is effectively cooled by the passing air flow. However, the spreading method has the drawback that it necessitates a relatively large amount of space in the depth direction.

In accordance with the construction, there is provided a thin convector of the kind described above, which is distinguished in that all the long sides of the tube are displaced, at one long side of the spiral and in the axial direction of the spiral, relatively to the corresponding long sides of the spiral turns at the other long side of the spiral.

A convector in accordance with the invention can be made by starting with an unbent tube, forming a bend in the tube, inserting the bent tube into a slot in one of a pair of vertically disposed support means spaced from one another, said plates containing oblique parallel slots, forming a fresh bend in the tube, and inserting this fresh bend into a slot in the other plate. This procedure is continued by bending the tube at predetermined intervals and introducing the bends into the plate slots, to form a flattened spiral.

By designing the convector in accordance with the present invention, the following advantages are achieved:

(1) the convector can be made thin;

(2) the wall thickness of the tube and the minimum bend radius, have little effect upon the minimum dimension of the convector;

(3) the convector spiral can be arranged in an accessible, narrow space in such a manner that convection is promoted (every part of the spiral can be completely exposed to the rising air flow and the latter is distributed substantially uniformly over all parts of the spiral);

(4) a finished tube spiral can rapidly and simply be assembled in a spreader structure which holds each part of the spiral in the proper position but does not restrict temperature-induced movements;

(5) the tube spiral, if required, can be cold-formed and immediately assembled in a suitable spreader structure which otherwise has the same characteristics as the one described in item (4) above.

Since the connecting lines of the convector can and should also consist of plastic, it is possible to arrange for the convector to be pivotably mounted on a wall, the flexibility of the connecting lines meaning that the convector can be dropped out for cleaning for example, without the need for any special precautions as far as the connection of the convector to the pipe system is concerned.

In this way, too, valves and connecting fittings become readily accessible for assembly and inspection. The connecting lines can be laid in the floor, in special floor skirtings or in the walls.

Further favourable features and advantages of the invention will be apparent from the ensuing description of a preferred embodiment of the invention, reference being made to the accompanying drawings.

Figure 1:
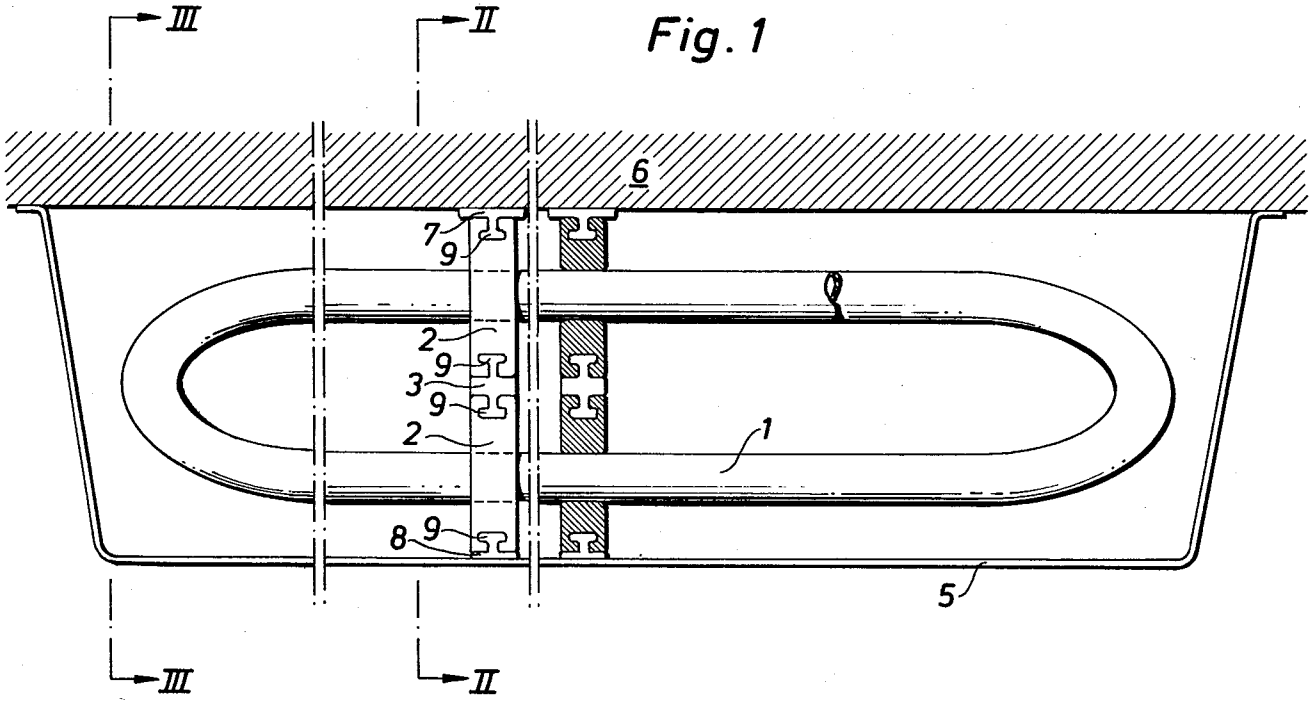
FIG. 1 illustrates a horizontal section through the convector in accordance with the invention.

FIG. 1 illustrates a horizontal section through a convector for space heating. The convector comprises a plastic tube 1 wound to spiral shape. The spiral is placed close to a wall 6 and closed by a screen 5. The screen 5 is provided in order, in association with the wall 6 to form an airduct which, by a chimney effect, improves convection of the air which flows through the duct and picks up heat from the hot medium flowing through the tube. The tube spiral is held together by means of spreader stays 2 which are in turn held together by means of locking strips 3. Fixing rails 7, 8 which are fixed to the wall 6 and screen 5, attach the screen to the spreader stays, and the spreader stays, along with the tube spiral, to the wall.

Figure 2:
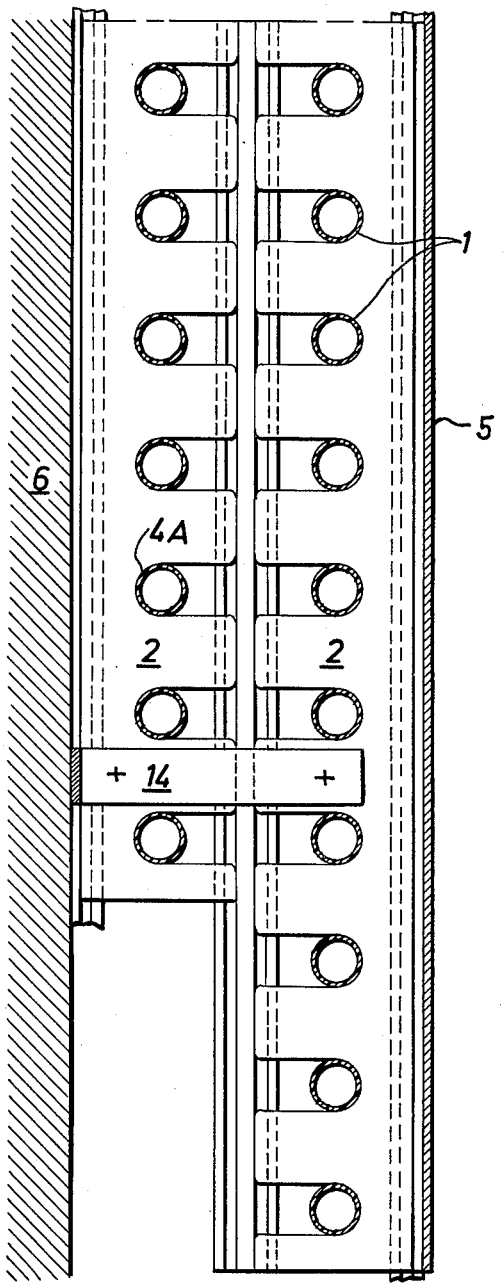
FIG. 2 illustrates a section on line II—II of FIG. 1.
Figure 4:
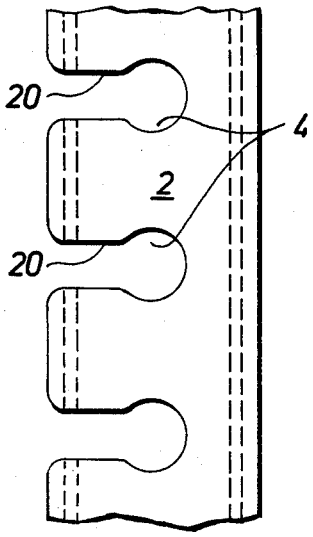
FIGS. 4 - 6 illustrate details of tube spreaders used to fix the convector spiral.
Figure 3:
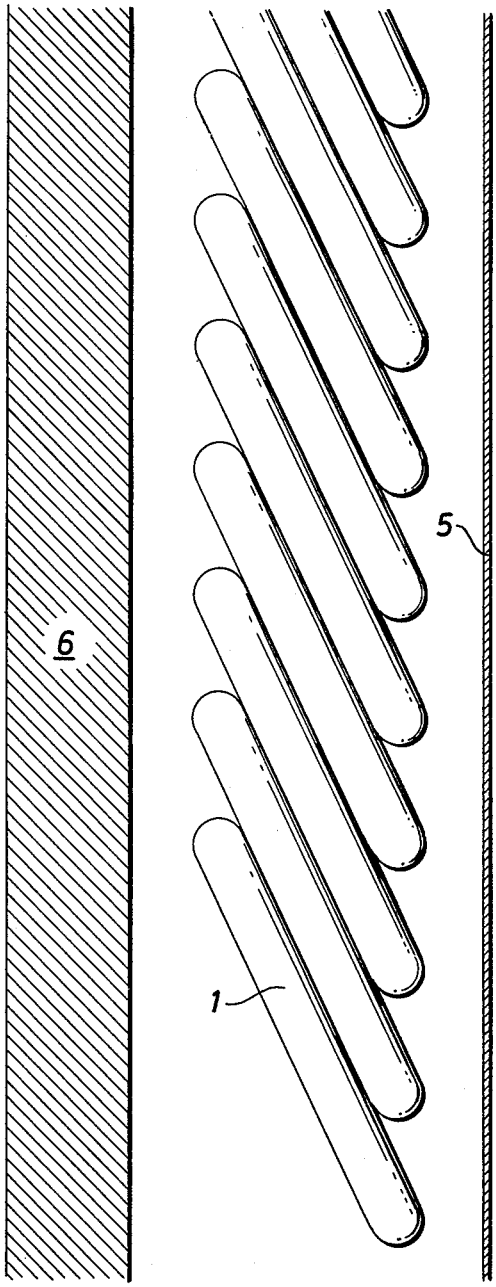
FIG. 3 illustrates a section on line III—III of FIG. 1.
Figure 5:
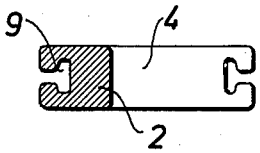
Figure 6:
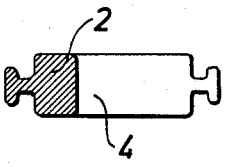

As FIGS. 2 and 4 show, the spreader stays exhibit openings 4 for the tube 1. The locking strips 3 and fixing rails 7 and 8 are of dovetail profile and are designed to co-operate with undercut openings 9 in the spreader stays. Naturally, the dovetail configuration can be used in the reverse manner, in which case the spreader stay design takes the form shown in FIG. 6. Self-evidently, too, the connecting arrangement can equally well be of the snap connector type. FIG. 3 illustrates the oblique arrangement of the coil turns in the convector in accordance with the invention. FIG. 2, which is a view through the convector, similar to that of FIG. 3, illustrates the spreader stays 2 in the position they occupy when the shape of the tube spiral has been fixed. The stays and strips are fixed longitudinally in relation to one another, by means of locking pins or the like.

Figure 7:
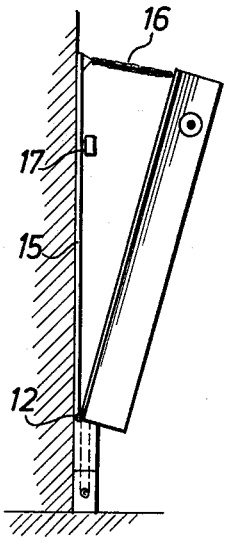
FIGS. 7 and 8 illustrate respective side and front elevations of a convector in accordance with the invention.
Figure 8:
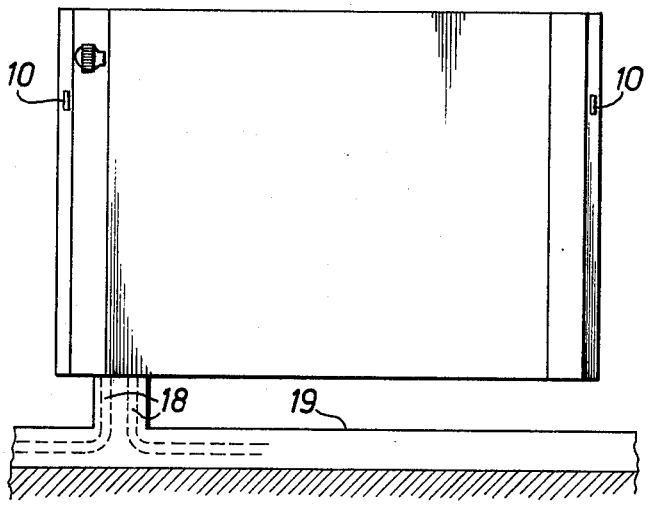
Figure 9:
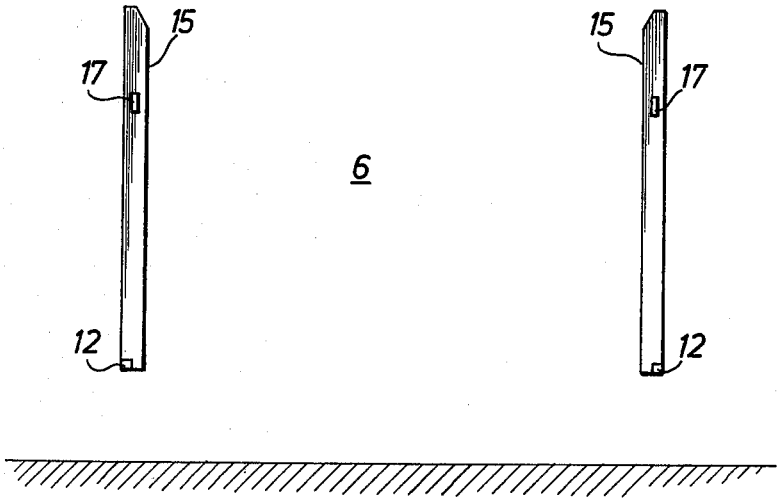
FIG. 9 illustrates the wall-mounting of the convector in accordance with FIGS. 7 and 8.

In the FIGS. 7 and 8, a convector can be seen in which the tube spiral is held together by spreaders, not shown, and is fixed to the screen plate. The screen plate is pivotally attached at 12 to wall brackets 15 which are in turn attached to the wall 6. A chain 16 is attached between the upper part of the screen plate and the upper part of the wall bracket 15, in order to limit the extent to which the convector can swing out. The convector screen 5 is provided at its sides with slots 10 the size of which is arranged to match the size of wing screws or wing nuts 17 mounted on the wall fixings at locations corresponding to the positions of the slots 10. The radiator can thus be dropped out from the wall bracket after the wing screws 17 have been aligned with the slots 10.

Because the pipe connections 18 of the convector are made of plastic, the convector can be dropped out without it being necessary to take any special precautions in relation to the connecting pipes. The pipes 18, as FIG. 8 shows, are laid in a floor skirting 19 which protects, supports and isolates the pipes 18.

In order to manufacture the convector of the invention, the plastic tube can be wound in a winding machine, to the shape of a substantially flat spiral. Then, the spreader stays 2 of FIG. 2 can be placed from the exterior, in pairs, centrally opposite one another at the long sides of the coil. The stays 2 of FIG. 2 contain recesses 4a with a size corresponding to the external diameter of the tube 1.

This done, one stay is displaced longitudinally relative to the other and the stays 2 brought together, whereafter they are locked to each other by the locking strip 3 which is slid down through the grooves 9 in the strips 2. When this has been done, the screen plate 5 can be attached to a stay 2 by means of its fixing rail 8 which is guided down through a groove 9 in the stay 2. The tube spiral 1, held down together by the spreader stays 2 and the locking strip 3, is now equipped with a screen plate 5 and the complete assembly can be supplied ready for installation, to the site where wall fixings 15 can be provided in order to permit the convector unit to be mounted straight away.

An alternative method of manufacturing the convector is to assemble the stays 2 of FIG. 4 of the reel by means of which the tube spiral is wound, with their recesses 4 disposed outward, while the tube is still warm after the crosslinking process so that the tube, following winding, snaps into position through the narrow section 20 of the recesses 4. After removal of the reel, the stays 2 can then be longitudinally displaced and fastened together in the manner described above. By the last-mentioned process the assembly of the spiral can be facilitated.

It should be clearly understood that the shearing or turning over, proposed in accordance with the invention, is not dependent on any prerequisite of straight tube long sides. It is sufficient in fact, if the turns of the tube spiral have a flattened form, for example an oval form. Obviously, however, the convector in accordance with the invention can more readily have its height restricted if the turns of the spiral have straight long sides.

In the case of a spiral tube convector surrounded by a screen plate, the best convection efficiency is achieved if the tube distribution is such that each unit length of tube is passed by an equal air flow. This means that the distance between the screen and the outside of the spiral should be approximately the same as half the distance between the long sides of the spiral. This in turn means that the screen convector has a minimum dimension which is closely dependent upon the distance between the long sides of the coil, and this emphasises the technical effect of the present invention.

Using a convector in accordance with the present invention, with a cross-linked polyethylene tube having an external diameter of 12 mm and an effective thickness of 1 – 2 mm, it is possible within an external size range of $100 \times 60 \times 8$ cm to obtain 16 to 17 turns. In this way, the convector can achieve a performance of around 1.0 kW if the mean temperature difference between the room and the convector water, is 50° C.

Although the convector has been described as a wall-mounted unit, it should be clearly understood that it can also be used as a free-standing convector.

The convector can be controlled by means of a thermostat valve located at any suitable position. The valve can be arranged in the convector connecting line, i.e. in the neighbourhood of the floor, or can be arranged at the upper part of the convector in which case, conveniently, an opening will be provided at the top, lateral part of the screen plate 5. Alternatively, a thermostatically controlled damper can be arranged at the top of the screen plate.

The tube spreader structure can be made of polypropylene. In the mass production context, ordinary moulding or extrusion-moulding techniques, in association with punching, will be used.

In FIG. 2, by way of an appropriate example, an illustration has been given of an axial displacement on the part of one long side of the spiral, amounting to three times the vertical centre to centre distance between the long sides of the coil. Accordingly, in FIG. 2, the turns of the spiral are at an angle of 25° to the axial direction of the spiral. If this angle were to be reduced, then the vertical distance between adjacent long sides of the tube would have to be increased, and this is more clearly indicated in FIG. 3. Generally speaking, it can be said that the arrangement in accordance with the invention has a surprisingly good influence upon the installation depth when the turns of the spiral are at an angle of 45° to the axial direction of the spiral.

Figure 11:
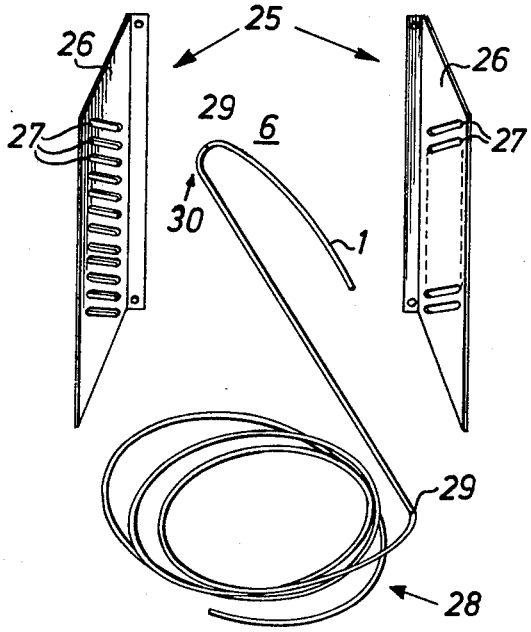

FIG. 11 illustrates a favourable method of manufacturing a convector. At the position at which the convector is to be fitted, two spreader structures 25 can be fitted, as for example on a wall 6. Each spreader structure 25 consists fundamentally, of a plate 26 containing oblique slots or openings 27, produced for example by punching. The inclination of the slot is matched to the desired inclination of the tube coil turns in the finished convector. The convector tube 1 is supplied from the factory in the form of a tube coil 28, this being the normal method of supplying tube and hose material. The tube 1 can be provided with markings 29, at an interval corresponding to half the loop-length of the convector spiral.

The assembly fitter bends the tube at a mark 29 and fits the tube bend 30 into an oblique slot, for example the top-most one in the left-hand spreader 25 of FIG. 11. This done, the fitter bends the tube at the next mark 29 and inserts this bend into the top-most slot in the right-hand spreader, and so on, until the desired number of spiral turns has been produced. The slot has therefore two functions, namely on the one hand to give the turns of the tube an inclined attitude, and on the other hand to hold the tube in the flattened, spiral or helical form.

The spreaders 25 can be pivotably fitted on the wall, for example, in the way shown in FIG. 7.

Self-evidently, the spreaders can be fixed to a screen plate and this assembly, as a unit, can in turn be arranged to be pivotably fitted on a wall. The latter is the preferred embodiment, and the convector is normally built in this manner in the factory.

Figure 12:
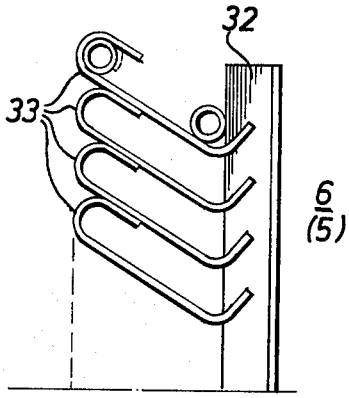
FIG. 12 illustrates a variant embodiment of the tube spreader shown in FIG. 10.

The tube spreader shown in FIG. 12 comprises an L-section profile 32 and obliquely orientated wire hooks 33. The neighbouring hooks 33 will conveniently be attached to opposite sides of the body of the L-section profile. The hooks as well as the L-section profiles can be made of metal such as steel, and can be welded to said L-section profile.

The requisite number of said spreaders are attached to one screen plate. At the time of assembly of the spiral the plastic tube is bent sufficiently to enable the bend to be inserted into the substantially oval opening which two hooks form in relation to one another. By successively bending the plastic tube to form oval configurations the ends of which are inserted into the oval openings in the two spreaders (as in the embodiment of FIG. 11), the tube is both shaped and fixed in a spiral form. The spring force in the tube bends, holds the latter properly fixed in the spreaders.

In convectors of medium and large size, the central part of the coil also requires supporting and fixing. This can be done for example, by using spreader stays of the kind referred to above. The lower one of the long sides of the coil turns is suitably fixed in the pocket formed by the angle iron and the hook. The top long side of the turns of the coil can be fixed by bending the free end of the hook around the tube or, for example, by clamping a plastic washer over the external end of the hook. It should be pointed out that if the spreader of FIG. 12 is to be used to fix the central part of the convector coil, then the hooks should have spring characteristics so that the tube can be pressed in from the front, not threaded in from the side in the manner of the embodiment of FIG. 11.

Figure 10:
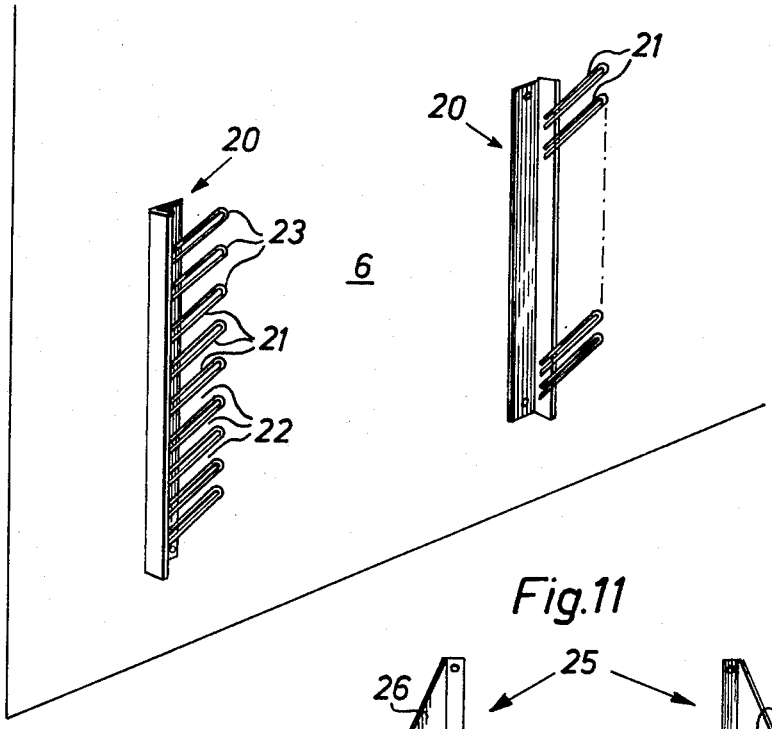
FIGS. 10 and 11 illustrate alternative embodiments of tube spreaders.

Furthermore, it should be clearly understood that the spreaders of FIGS. 10, 11 and 12, can advantageously be attached to a screen plate, which, in turn, after the assembly of the tube spiral can be attached to a wall or the like.

Within the context of the invention, it is also possible to manufacture the convector by first of all producing a simple, flattened tube spiral and by then providing a wall bracket 20 with obliquely inclined (60° from the horizontal plane) suspension means 21 for each coil turn (FIG. 10).

An expanded coil form is thus created by virtue of the fact that each turn of the coil is introduced into a space 22 between each suspension means 21. In this case, a screen plate can be assembled directly on the wall 6 or on the outer parts 23 of the suspension means 21, which latter can be arranged to cooperate with the screen plate, for example by means of a dovetail attachment in the manner described in the context of earlier embodiments.

What is claimed is:

1. A wall mountable tube convector for heating air wherein air is heated by contact with hot tubes and rises by convection, said convector comprising a hot liquid conducting plastic tube of high thermal stability formed into a plurality of tube windings extending in the form of a vertically oriented flattened helix having a central, axially extending vertical plane parallel to the flattened sides of the helix, all the helix windings being arranged in parallel planes intersecting said central vertical plane along substantially horizontal lines and extending obliquely to the horizontal, tube spreaders between the windings arranged to maintain said windings in a predetermined shape and at predetermined mutual intervals, the first mounting means cooperating with the tube windings for mounting said tube on a wall spaced a distance from said wall, a screen enclosing said tube coils, and second mounting means for mounting said screen on said tube coils spaced a distance from said coils, said screen, in cooperation with the wall, forming an open-ended chimney around said tube coils, whereby said first and second mounting means produce a double flue effect to permit every part of the spiral to be exposed to a substantially unobstructed, uniform airflow in and about said coils to increase heat transfer.

2. A convector as claimed in claim 1 wherein the tube spreaders constitute said first mounting means and comprise vertically oriented stays for mounting on the wall said stays having a plurality of oblique, upwardly-directed support means, adjacent support means defining spaces for receiving the windings of the flattened helix, the distance between adjacent support means corresponding to the external diameter of the tube.

3. A convector as claimed in claim 1 wherein the planes of the helix windings intersect the central vertical plane at an angle of from 25° to 45° and the distance between adjacent coil turns of the spiral is less than the distance between the long sides of the flattened spiral.

4. A convector according to claim 3 wherein adjacent coil turns touch each other.

5. A convector according to claim 1 wherein the planes of the helix windings form an angle of about 60° with the horizontal.

* * * * *